United States Patent [19]

Phillips

[11] Patent Number: 4,678,689

[45] Date of Patent: Jul. 7, 1987

[54] TRANSPARENCY LAMINATION PROCESS

[75] Inventor: Randall Phillips, 40 W. 22nd St., 11th Floor, New York, N.Y. 10010

[73] Assignees: Randall Phillips; Sumiko Phillips, ; a part interest

[21] Appl. No.: 746,857

[22] Filed: Jun. 20, 1985

[51] Int. Cl.[4] ..... B44F 1/02; B44F 1/06

[52] U.S. Cl. ..... 428/13; 40/158 B; 156/108

[58] Field of Search ..... 40/158 B, 159; 156/108; 428/13, 14, 532; 430/12, 14, 13

[56] References Cited

U.S. PATENT DOCUMENTS

| | | | |
|---|---|---|---|
| 2,896,351 | 7/1959 | Johnson | 40/158 B |
| 3,509,002 | 4/1970 | Edwards et al. | 428/332 |
| 3,587,187 | 6/1971 | Sibley | 40/159 |
| 3,642,552 | 2/1972 | Sibley | 40/159 X |
| 3,737,364 | 6/1973 | Heindl, Jr. | 428/43 X |
| 3,868,293 | 2/1975 | Selph | 428/14 X |
| 3,983,277 | 9/1976 | Ackerman et al. | 428/13 X |
| 4,046,951 | 9/1977 | Stefanik | 428/38 X |
| 4,231,833 | 11/1980 | Lieberman | 428/14 X |
| 4,255,308 | 3/1981 | Brasen | 428/334 X |
| 4,296,179 | 10/1981 | Wardwell | 428/43 X |
| 4,330,350 | 5/1982 | Andrews | 428/13 X |
| 4,376,159 | 3/1983 | Spechler | 430/14 X |

FOREIGN PATENT DOCUMENTS

| | | | |
|---|---|---|---|
| 1168539 | 10/1969 | United Kingdom | 156/108 |

*Primary Examiner*—Henry F. Epstein

*Attorney, Agent, or Firm*—Kane, Dalsimer, Kane, Sullivan and Kurucz

[57] ABSTRACT

A laminated transparency is covered on its top and bottom face with a top sheet of clear vinyl transparency and a bottom sheet of clear vinyl. A sheet of mat polyester is over the bottom face of the bottom vinyl sheet during the lamination process to provide a mat finish across the bottom of the lamination. The sheet and transparencies are subjected to heat and pressure to laminate these parts together. Both sides of the transparency are coated prior to lamination to facilitate its adherence to the top and bottom sheets of clear vinyl. The top and bottom sheets of clear vinyl may also be peeled from the transparency. A pair of sheets with windows have the laminated transparency interposed therebetween with the transparency viewable through the windows.

11 Claims, 4 Drawing Figures

FIG.4
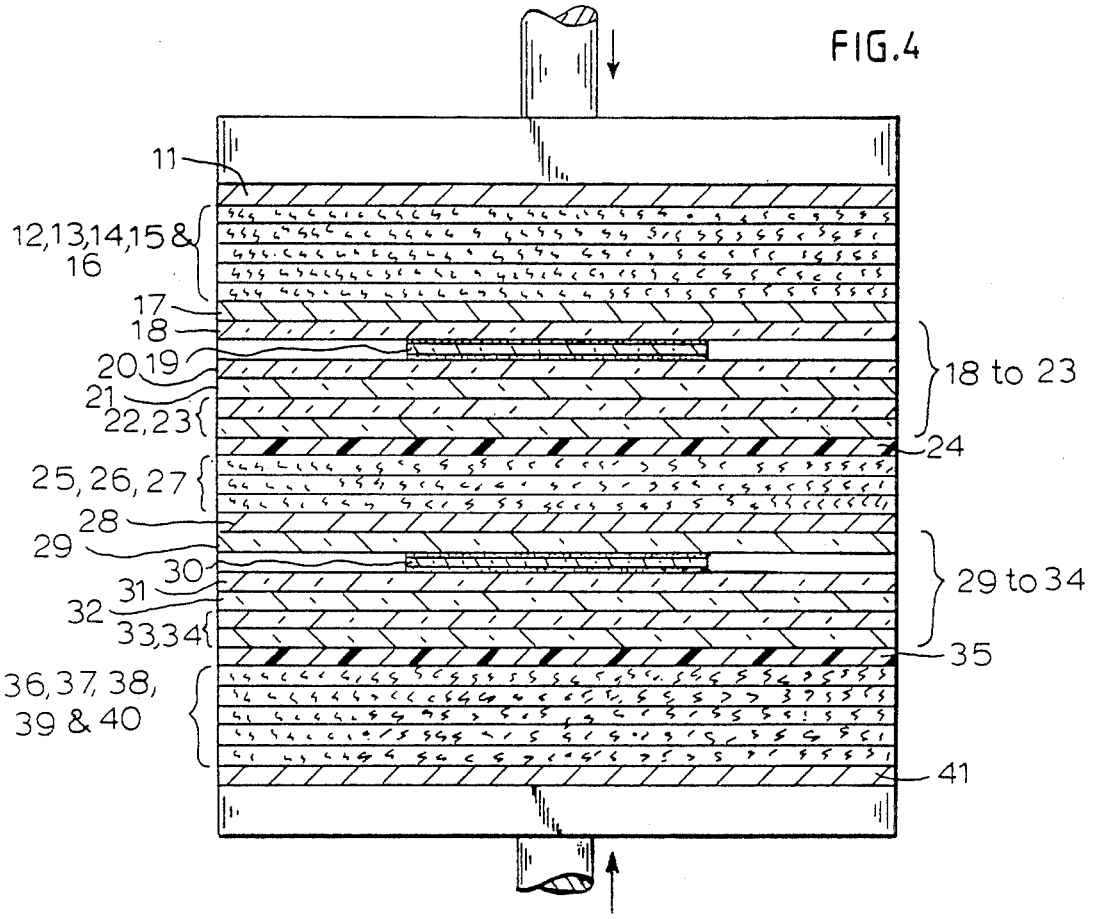
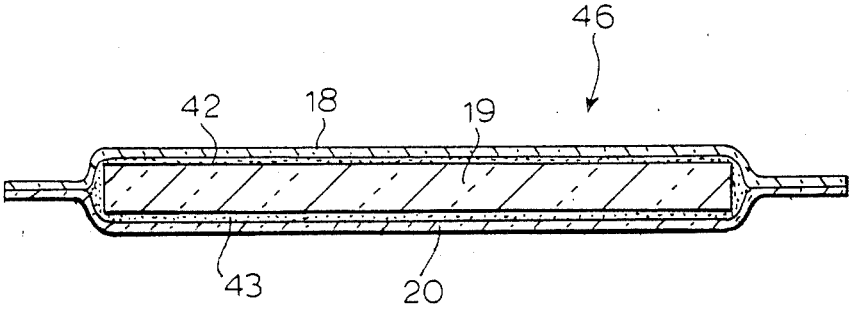
FIG.3

TRANSPARENCY LAMINATION PROCESS

BACKGROUND OF THE INVENTION

Heretofore, transparencies or film positives were mounted between die cut pieces of cardboard for presentation purposes with the cardboard having die cut windows therein. The edges of the cardboard that define the window, would have to be blackened because the white fibers from the cut would be exposed. The transparency or positive would be taped in place to one of the cardboard pieces and both cardboard pieces would then have a tape extended around the periphery thereof. Photographers would present their work in this fashion. However, with time, the transparencies or positives would become damaged or scratched with repeated handling and usage.

In the art of laminating, in general, a mat quality is produced with a mat plate. The industry generally used either anodized aluminum or a nickel plate or sandblasted chrome plate, but nevertheless a plate that produced a mat quality. If a transparency were disposed between two plates the plates of this type would bend because the thickness of the transparency would causes stresses that would bend the two plates.

Heretofore there was no way to obtain a lamination having a flat appearing back. If the back of a normal piece of work that has been laminated is viewed, it appears very ripply. In conventional laminating, generally cardboard or rubber is used to give a sponginess to take up the thickness of the work. Whether cardboard or rubber is used, a softly undulating pattern is obtained which is quite evident when lamination of a transparency is attempted. The lamination would appear bumpy on the back. It was also assumed the transparency would melt at the usual lamination temperatures. Thus, those skilled in the art did not consider lamination of transparencies as being feasible because of the danger of melting the transparency and the inherent undulating or rippled effect on the back of the transparency. Accordingly, today when transparencies are viewed, other than a 35 mm which is viewed on a projector, in a portfolio presentation, they are between sheets of cardboard. As previously explained, problems arise with time in prior art cardboard mounted structures and damage of the transparencies result inasmuch as they are completely unprotected.

SUMMARY OF THE INVENTION

A principal object of this invention is to provide a laminated transparency. Another unique attribute of this invention is the use of mat polyester to provide a mat quality while heretofore mat quality has always been given by mat plates.

An advantage of the product of this invention is that a transparency is completely sealed in vinyl. This permits (1) protection of the transparency and (2) offers a very clinging pristine way of viewing photographic work. The end product is very clean and crisp and it can be done in a variety of forms.

The present invention solves the problem of getting vinyl to stick to the transparency. This is accomplished with the use of a Krylon coating. Crystal clear Krylon #1301, an acrylic clear lacquer spray coating, supplied in an aerosol type of package by the Borden, Inc., Ink Company of Columbus, Ohio, is sprayed on both sides of the transparency. The vinyl binds to the Krylon which, in turn, binds to the transparency. The use of this spray permits the transparency to be delaminated should it be necessary to relaminate it at some future time. Krylon permits the vinyl to be peeled from the transparency.

In addition the present invention provides for the first time a lamination process whereby the transparency may be placed in and protected by a laminated envelope. The sandwiching of the laminated envelope within die cut windows of vinyl sheets provides further protection for the matted surface of the transparency.

Furthermore, the present invention reduces if not eliminates stippling which appears quite common as a result of conventional lamination techniques because of the resilient backing plate that is normally utilized in the lamination process.

In a typical set-up according to this invention, five sheets of cardboard, a chrome plate, one sheet of clear vinyl, the transparency to be laminated (the transparency front faces the chrome plate), another sheet of clear vinyl, a sheet of mat polyester, two sheets of clear polyester that are the release agents, and a sheet of formica (melamine impregnated plastic laminate) with the hard side towards the back of the work are used. The formica plus three layers of polymers provides the back. Then another set-up employed with three sheets of cardboard, another chrome plate, a sheet of clear vinyl, the transparency, a sheet of clear vinyl, a sheet of mat polyester, two sheets of clear polyester, another sheet of formica with the hard side towards the back of the work, five sheets of cardboard and a tray bottom.

BRIEF DESCRIPTION OF THE DRAWINGS

FIG. 3 is an enlarged cross-sectional view of the laminated transparency; and FIG. 4 is a fragmentary sectional view showing a pair of set-ups for laminating transparencies disposed within a lamination press.

DETAILED DESCRIPTION

Figure 1:
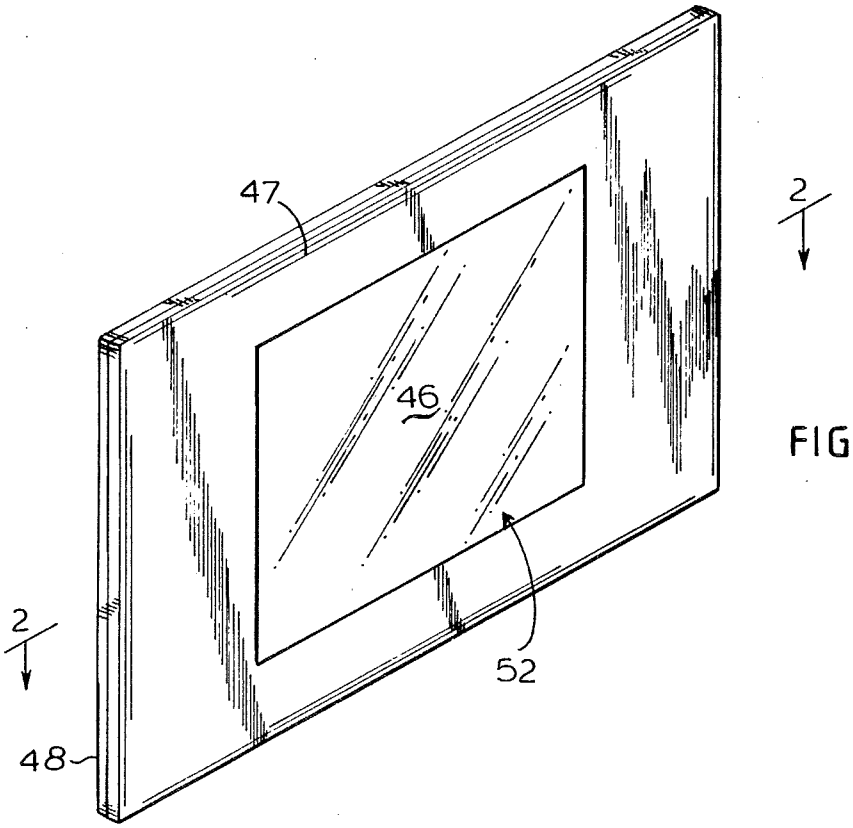
FIG. 1 is a perspective view of a mounted laminated transparency according to the present invention.
Figure 2:
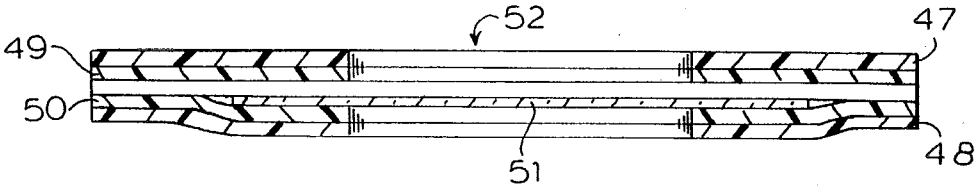
FIG. 2 is a cross-section taken along the line 2—2 of FIG. 1.

Referring to FIG. 4 a typical set-up or lay-up according to the present invention is shown. Starting from the top, a metallic or steel tray top 11 extends over five sheets of cardboard 12, 13, 14, 15, and 16 of the archival variety. A chrome plate 17 is below the last layer 16 of cardboard and a top sheet of clear vinyl 18 extends below the chrome plate 17 and over the transparency 19 the front of which faces the chrome plate 17. Below the transparency 19 is a clear vinyl bottom sheet 20. Below this clear vinyl bottom sheet 20 is a sheet of mat polyester 21 below which appear two sheets of clear polyester 22 and 23. A sheet of formica 24 with the surface up towards the back of the transparency is below sheet 23. Sheets 21–24 provide cushioning or resiliency layers or bodies that facilitate the lamination process.

The second set-up includes three sheets of cardboard 25, 26 and 27 below which appears chrome plate 28. Below the chrome plate 28 is the clear vinyl top sheet 29 below which appears the transparency 30 with its front face towards the chrome plate 28. Below the transparency 30 is the clear vinyl bottom sheet 31 and then the mat polyester sheet 32. Two clear polyester sheets 33 and 34 are between the mat polyester sheet 32 and the formica sheet 35 with the face up. Below the formica sheet 35 appears five cardboard sheets 36, 37, 38, 39 and 40 and then appears the metal or steel bottom tray 41.

Before the transparencies 19 and 30 are placed in the set-ups each transparency is sprayed on both sides with the crystal clear Krylon lacquer coating 42, 43, which is an acrylic spray coating supplied in an aerosol package by the Borden, Inc., Company of Columbus, Ohio. As stated earlier, the vinyl appearing on both sides of the transparency does not stick or adhere to the transparency under normal conditions but with the presence of Krylon a peelable adherence is obtained. The present invention produces a perfect mat viewing surface on the back of the laminated vinyl sheets.

The two set-ups or lay-ups are placed in a conventional and commercially available hydraulic heated and cooled transfer or laminating press shown schematically in FIG. 4 in which the set-ups and lay-ups are capable of being exposed to a heating cycle and a separate cooling cycle. In this connection, the lay-ups or set-ups are heated for eight minutes which time may vary either way depending on ambient conditions including temperature and humidity. The cooling cycle is also for eight minutes. Both the heating and cooling is under essentially the same pressure of approximately 600 lbs/sq. inch with the heating being approximately 250° F.

In completing the mounting of laminated transparency 46 virgin vinyl sheets 47, 48 are used. These vinyl sheets have a rectangular or square opening 52 that serve as a window to view the laminated transparency 46. Scotch 568 positionable mounting adhesive sheets 49, 50 produced by the 3M Corporation is initially put on one face of both sheets 47, 48, respectively, before the opening is made. Sheets 49, 50 may have release paper on one side for this application. This application may be done by using a C35 PMA applicator manufactured by the 3M Company, that possess two pressure rolls that facilitate the desired adherences. Then the openings are cut. The window can be cut to fit the image. The exposed face of sheets 47, 48 may possess release paper which is now removed. One sheet 47 with a window is then positioned (also with window) on the front of the laminated transparency 46, and the other sheet 48 on the back. Before placing the sheet 48, a thin mat acetate sheet 51 is interposed between this sheet and the laminated transparency 46. This acetate sheet protects the mat finish on the vinyl sheet 20 which is easily scratched and damaged. The assembly is secured by using a hand roller or brayer to bond the pressure sensitive adhesive of the sheets 49, 50 to the clear vinyl envelope containing the transparency. The entire assembly is then trimmed to size.

Thus, the several aforenoted objects and advantages are most effectively attained. Although several somewhat preferred embodiments have been disclosed and described in detail herein, it should be understood that this invention is in no sense limited and its scope is to be determined by that of the appended claims.

What is claimed:

1. A laminated transparency comprising:

a transparency having a top and bottom face;

clear plastic sheets extending over the top and bottom face of the transparency;

a mat finish on the bottom face of the bottom plastic sheet; and, lamination means for laminating the sheets and transparency together to provide a completely sealed transparency for viewing and to protect the transparency.

2. A laminatated transparency comprising:

a transparency having a top and bottom face;

a top and bottom sheet of clear plastic over the respective top and bottom face of the transparency;

mat simulating surface means over the bottom sheet for producing a mat finish when viewing the transparency from the top; and lamination means for laminating the sheets and transparency together to provide a completely sealed transparency for viewing and to protect the transparency.

3. A laminated transparency comprising:

a transparency having a top and bottom face;

a top sheet of clear vinyl on the top face of the transparency;

a bottom sheet of clear vinyl on the bottom face of the transparency and also having a bottom face;

mat simulating surface means on the bottom face of the bottom sheet; and lamination means for laminating the sheets and transparency together to provide a transparency completely sealed in vinyl for viewing and to protect the transparency.

4. A laminated transparency according to claim 3 wherein both sides of the transparency are coated to facilitate the adherence thereto of the top and bottom sheets of clear vinyl.

5. A laminated transparency according to claim 4 wherein the coating is selected from materials permitting the top and bottom sheets of clear vinyl to be peeled from the transparency.

6. A laminated transparency according to claim 5 wherein a pair of sheets with windows have the laminated transparency interposed therebetween with the transparency viewable through the windows of the pair of sheets.

7. A process for laminating a transparency comprising the steps of:

providing a transparency having a top and a bottom face;

a coating the transparency;

placing the transparency between top and bottom sheets of clear plastic;

subject the sheets and transparencies to heat and pressure to laminate these parts together to completely seal the transparency for viewing and to protect the transparency and produce a mat finish on the bottom sheet.

8. A process according to claim 7 wherein the top and bottom sheets of clear plastic is selected from a vinyl resin.

9. A process according to claim 7 wherein placing a mat finish plastic sheet across the bottom of the bottom sheet of clear plastic will cause a mat finish on the bottom sheet of clear plastic as a result of the lamination process.

10. A process according to claim 9 wherein the mat finish plastic sheet is selected from a polyester resin.

11. A process according to claim 7 wherein a peelable resin coating is applied to the transparency prior to placement between the clear plastic sheets to facilitate delamination and removal of the transparency.

* * * * *